US011920902B2

(12) United States Patent
Batchelder

(10) Patent No.: US 11,920,902 B2
(45) Date of Patent: Mar. 5, 2024

(54) PRESSURE AND HEAT CONDUCTED ENERGY DEVICE AND METHOD

(71) Applicant: Convey Technology, Inc., Woodinville, WA (US)

(72) Inventor: J. Samuel Batchelder, Woodinville, WA (US)

(73) Assignee: Convey Technology, Inc., Woodinville, WA (US)

( * ) Notice: Subject to any disclaimer, the term of this patent is extended or adjusted under 35 U.S.C. 154(b) by 399 days.

(21) Appl. No.: 17/292,180

(22) PCT Filed: Nov. 11, 2019

(86) PCT No.: PCT/US2019/060774
§ 371 (c)(1),
(2) Date: May 7, 2021

(87) PCT Pub. No.: WO2020/162997
PCT Pub. Date: Aug. 13, 2020

(65) Prior Publication Data

US 2021/0389102 A1 Dec. 16, 2021

Related U.S. Application Data

(60) Provisional application No. 62/758,089, filed on Nov. 9, 2018.

(51) Int. Cl.
*F41H 13/00* (2006.01)

(52) U.S. Cl.
CPC ..... *F41H 13/0025* (2013.01); *F41H 13/0037* (2013.01)

(58) Field of Classification Search
CPC ..... F41H 13/0025; F41H 13/0037
See application file for complete search history.

(56) References Cited

U.S. PATENT DOCUMENTS 8,843 A 3/1852 Sonnenburg
253,315 A 2/1882 Sanford
(Continued)

FOREIGN PATENT DOCUMENTS

CA 2921708 A1 * 8/2017 ..... F41B 9/00
WO 2006134596 A2 12/2006
(Continued)

OTHER PUBLICATIONS

First Examination Report dated Oct. 26, 2022 for corresponding Indian Patent Application No. 202127017434, filed Apr. 14, 2021.
(Continued)

*Primary Examiner* — Sisay G Tiku
(74) *Attorney, Agent, or Firm* — Peter J. Ims; Westman, Champlin & Koehler, P.A.

(57) ABSTRACT

A method of delivering charge to a remote target includes pressurizing a reservoir of metallic conductor initially at a temperature below its melting point. The method includes flowing the metallic conductor through an orifice to form a continuous thread with axial velocity, so that a user might direct the axial velocity of the thread to intercept the remote target. The method further includes applying a potential differential along the thread so that electrical current flows between the reservoir and the remote target.

29 Claims, 12 Drawing Sheets

(56) References Cited

U.S. PATENT DOCUMENTS

| | | | |
|---|---|---|---|
| 3,374,708 | A | 3/1968 | Wall |
| 3,803,436 | A | 4/1974 | Morrell |
| 3,971,292 | A | 7/1976 | Paniagua |
| 4,006,390 | A | 2/1977 | Levine |
| 4,424,932 | A | 1/1984 | Allen |
| 4,719,534 | A | 1/1988 | Ward |
| 4,846,044 | A | 7/1989 | Lahr |
| 4,852,454 | A | 8/1989 | Batchelder |
| 4,893,815 | A | 1/1990 | Rowan |
| 5,103,366 | A | 4/1992 | Battochi |
| 5,225,623 | A | 7/1993 | Krasnow |
| 5,409,638 | A | 4/1995 | Battochi |
| 5,457,597 | A | 10/1995 | Rothschild |
| 5,473,501 | A | 12/1995 | Claypool |
| 5,625,525 | A | 4/1997 | Coakley et al. |
| 5,654,867 | A | 8/1997 | Murray |
| 5,675,103 | A | 10/1997 | Herr |
| 5,698,815 | A | 12/1997 | Ragner |
| 5,786,546 | A | 7/1998 | Simson |
| 5,936,183 | A | 8/1999 | McNulty, Sr. |
| 5,955,695 | A | 9/1999 | McNulty, Sr. |
| 5,962,806 | A | 10/1999 | Coakley et al. |
| 6,022,120 | A | 2/2000 | Chang |
| 6,272,781 | B1 | 8/2001 | Resnick |
| 6,636,412 | B2 | 10/2003 | Smith |
| 6,643,114 | B2 | 11/2003 | Stethem |
| 6,679,180 | B2 | 1/2004 | Warnagiris et al. |
| 6,862,994 | B2 | 3/2005 | Chang |
| 6,898,887 | B1 | 5/2005 | Stratbucker |
| 7,042,696 | B2 | 5/2006 | Smith et al. |
| 7,075,770 | B1 | 7/2006 | Smith |
| 7,237,352 | B2 | 7/2007 | Keely et al. |
| 7,314,007 | B2 | 1/2008 | Su |
| 7,336,472 | B2 | 2/2008 | Nerheim et al. |
| 7,350,466 | B2 | 4/2008 | Hendrix |
| 7,363,742 | B2 | 4/2008 | Nerheim |
| 7,421,933 | B1 | 9/2008 | Pearson |
| 7,457,096 | B2 | 11/2008 | Brundula |
| 7,520,081 | B2 | 4/2009 | Kroll |
| 7,570,476 | B2 | 8/2009 | Nerheim |
| 7,586,733 | B2 | 9/2009 | Nerheim |
| 7,600,337 | B2 | 10/2009 | Nerheim et al. |
| 7,602,597 | B2 | 10/2009 | Smith et al. |
| 2,805,067 | A1 | 12/2009 | Leavitt |
| 7,676,972 | B2 | 3/2010 | Smith et al. |
| 7,701,692 | B2 | 4/2010 | Smith et al. |
| 7,736,237 | B2 | 6/2010 | Stethem et al. |
| 7,782,592 | B2 | 8/2010 | Nerheim |
| 7,800,885 | B2 | 9/2010 | Brundula et al. |
| 7,944,676 | B2 | 5/2011 | Smith et al. |
| 7,984,579 | B2 | 7/2011 | Brundula et al. |
| 8,087,335 | B2 | 1/2012 | Shekarri |
| 8,166,693 | B2 | 5/2012 | Hughes et al. |
| 8,277,328 | B2 | 10/2012 | Stethem et al. |
| 8,321,474 | B2 | 11/2012 | Schilken |
| 8,549,783 | B2 | 10/2013 | Marquez |
| 8,572,876 | B2 | 11/2013 | Shekarri et al. |
| 8,594,485 | B2 | 11/2013 | Brundula |
| 8,743,527 | B2 | 6/2014 | Brundula |
| 8,837,901 | B2 | 9/2014 | Shekarri et al. |
| 9,025,304 | B2 | 5/2015 | Brundula et al. |
| 9,058,499 | B1 | 6/2015 | Smith |
| 9,182,193 | B1 | 11/2015 | Nerheim |
| 9,395,147 | B2 | 7/2016 | Gagnon et al. |
| 9,400,155 | B2 | 7/2016 | Bradshaw et al. |
| 9,518,727 | B1 | 12/2016 | Markle et al. |
| 9,642,131 | B2 | 5/2017 | Bohlander et al. |
| 10,011,247 | B2 | 7/2018 | Joao |
| 10,015,871 | B2 | 7/2018 | Handel et al. |
| 10,024,636 | B2 | 7/2018 | Nerheim |
| 10,054,405 | B2 | 8/2018 | Alherimi |
| 10,082,361 | B2 | 9/2018 | Forsythe et al. |
| 2009/0183413 | A1* | 7/2009 | Smith ..... F41B 9/0031 102/370 |
| 2013/0208392 | A1 | 8/2013 | Brundula et al. |
| 2015/0153144 | A1 | 6/2015 | Cheatham et al. |
| 2016/0284182 | A1 | 9/2016 | Havens |
| 2017/0241753 | A1 | 8/2017 | Nerheim |
| 2017/0245355 | A1 | 8/2017 | Handel et al. |
| 2018/0187999 | A1 | 7/2018 | Tremblay et al. |
| 2018/0259303 | A1 | 9/2018 | Nerheim et al. |
| 2019/0376768 | A1 | 12/2019 | Nerheim |
| 2022/0236027 | A1* | 7/2022 | Howard ..... F41A 19/60 |
| 2022/0236037 | A1* | 7/2022 | Batchelder ..... F41H 13/0025 |
| 2023/0040922 | A1* | 2/2023 | Howard ..... F41A 1/04 |

FOREIGN PATENT DOCUMENTS

| | | | |
|---|---|---|---|
| WO | 2020162997 | A2 | 8/2020 |
| WO | 2020236761 | A2 | 11/2020 |

OTHER PUBLICATIONS

Preliminary Office Action received from the Brazilian Patent Office for Brazilian Application No. 112021007890-8, dated Apr. 11, 2023.

International Search Report and Written Opinion of PCT/2019/060774, dated Sep. 15, 2020; 12 pages.

International Search Report and Written Opinion of PCT/US2020/033492 dated Dec. 18, 2020; 8 pages.

Jones, Nathaniel J. "Extruding Indium Wire" (2016) Retrieved from https://hydrogen.wsu.edu/2016/07/08/extruding-indium-wire/; 12 pages.

Assael et al., "Reference Data for the Density and Viscosity of Liquid Cadmium, Cobalt, Gallium, Indium, Mercury, Silicon, Thallium, and Zinc" J. Phys. Chem. Ref. Data, vol. 41, No. 3, 2012; 16 pages.

Fais, Alessandro, "Why is it not possible to strain harden Indium?" Retrieved from https://www.quora.com/Why-is-it-not-possible-to-strain-harden-Indium; 1 page.

Lee, Gyuhyon et al., "Plastic deformation of indium nanostructures" vol. 528, Issues 19-20, 2011, pp. 6112-6120; ISSN 0921-5093. Retrieved from https://www.sciencedirect.com/science/article/pii/S0921509311004977; 8 pages.

Axon Product information relating to the Taser Pulse. Retrieved from https://taser.com/products/taser-pulse on May 7, 2021.

* cited by examiner

PRESSURE AND HEAT CONDUCTED ENERGY DEVICE AND METHOD

CROSS-REFERENCE TO RELATED APPLICATION

This Application is a Section 371 National Stage Application of International Application No. PCT/US2019/060774, filed Nov. 11, 2019 and published as WO 2020/162997 A2 on Aug. 13, 2020, in English, which claims the benefit of U.S. Provisional Application Ser. No. 62/758,089 which was filed Nov. 9, 2018; the contents of all of which are hereby incorporated by reference in their entirety.

BACKGROUND

The present disclosure relates to a device that is configured to simultaneously extrude a plurality of metallic wires at a temperature initially below the melting temperature of the metallic material and deliver electrical energy to an object through the plurality of metallic wires. More particularly, the present disclosure relates to a device configured to extrude a plurality of metallic wires at a temperature below the melting temperature of the metallic material and deliver a non-lethal amount of electric energy sufficient to incapacitate a human being or an animal.

Non-lethal devices that impart incapacitating amount of electricity, commonly referred to as conducted energy devices (CEDS) or conductive energy weapons (CEWS), are used by many law enforcement and military forces. A 24,000-use case study shows that the use of CEDS or CEWS shows a 60% reduction in suspect injury relative to use of conventional weapons.

However, the use of conventional CEDS or CEWS can have significant costs, including having to purchase electricity carrying devices configured to engage a remote target. A common CED is sold under the TASER® by Axon Enterprise, Inc. located in Scottsdale, Ariz. A TASER® CED delivers current using two darts, propelled by gunpowder or spring drives, each of which tows insulated wire from spools in the launcher. Typical pistol style launchers have two pairs of darts, and a 15 ft to 30 ft effective range.

However, typical CEDS or CEWS, such as those sold under the TASER® designation, have shortcomings. These shortcomings include only being able to only shoot two shots at one target per shot. Further, the random tugging of the wires being payed out behind the darts can cause the darts to miss the target. Additionally, a range of 15 feet can be problematic in some instances, especially when the darts are brushed away from the target. Finally, the darts can impart permanent injury, especially to the eyes of a target.

There are other CEDS that utilize liquid or molten conductive beams. However, the ionic conductors, such as saltwater, generally have too much resistivity to carry the relatively high required peak currents.

Metal alloys that are molten at room temperature (NaK, mercury, gallium) are generally corrosive, poisonous, and/or expensive. The beams of these materials generally break up by Rayleigh instability.

Further, maintaining reservoirs of alloy at elevated temperature in a standby mode requires a significant amount of energy to compensate for heat loss. Alternatively, a handheld device will require a significant amount of volume for insulation. Both are problematic for a portable design.

Additionally, the range of effectiveness varies with the initial velocity and angle of elevation. The range limit is primarily set by the beams buckling because they are incapable of increasing in diameter as air or gravity slows them down.

Jetting downward at low velocity will markedly increase the range. However, in many instances, this is not a practical option.

SUMMARY

This disclosure, in its various combinations, either in apparatus or method form, may also be characterized by the following listing of items:

An aspect of the present disclosure includes a method of delivering current to a remote target. The method includes pressurizing a reservoir of metallic conductor initially at a temperature below its melting point. The method includes flowing the metallic conductor through an orifice to form a continuous thread with axial velocity, so that a user might direct the axial velocity of the thread to intercept the remote target. The method further includes applying a potential differential along the thread so that current flows between the reservoir and the remote target.

Another aspect of the present disclosure relates to a conductive energy weapon. The conductive energy weapon is configured to extrude a plurality of conductive threads initially at a temperature below a melting temperature of the material. The weapon includes a plurality of spaced apart extruders. Each extruder includes a barrel having a first end and a second end and configured to retain a supply of conductive metallic material, and an extrusion tip having an extrusion orifice ranging from about 3 mils to about 16 mils. Each extruder includes a piston configured to sealingly move within the barrel from a first end. The weapon includes a pressurization system engaging each piston and configured to move each piston within a respective barrel and a power supply configured to activate the pressurization system. The weapon also includes an electric pulse generator configured to supply non-lethal electrical energy through the extruded threads, and a controller configured to cause the pressurization system to move the pistons and raise a pressure on the conductive metallic material such that the material shears and raises a temperature proximate the extrusion nozzle sufficiently to extrude the threads of at velocity of between about 10 feet per second and about 160 feet per second and to cause electric pulses to travel along the extruded threads.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views. Moreover, analogous structures may be indexed in increments of one hundred. It is contemplated that all descriptions are applicable to like and analogous structures throughout the several embodiments.

Figure 1:
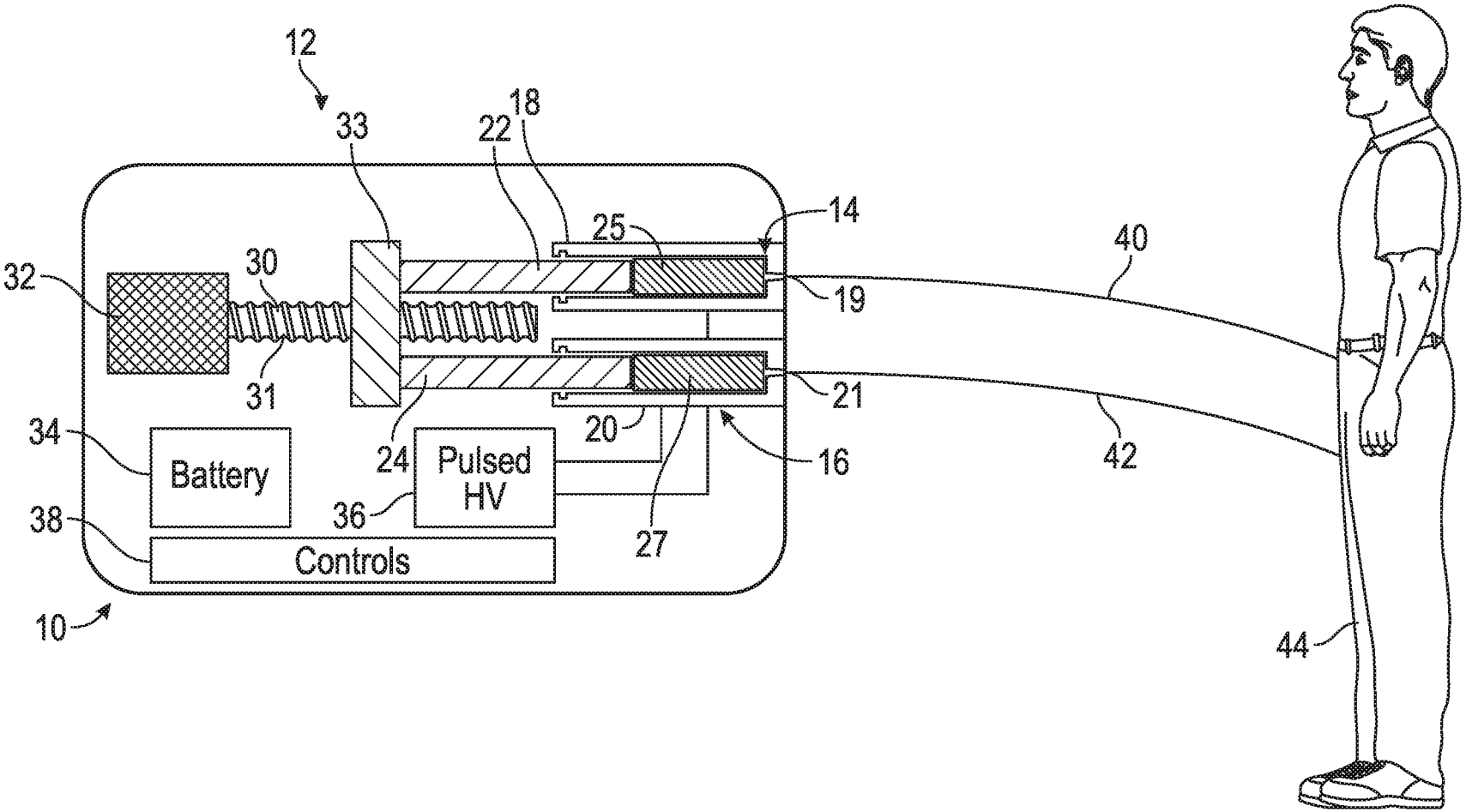
FIG. 1 is a schematic view of a hand-held conducted energy device.
Figure 2:
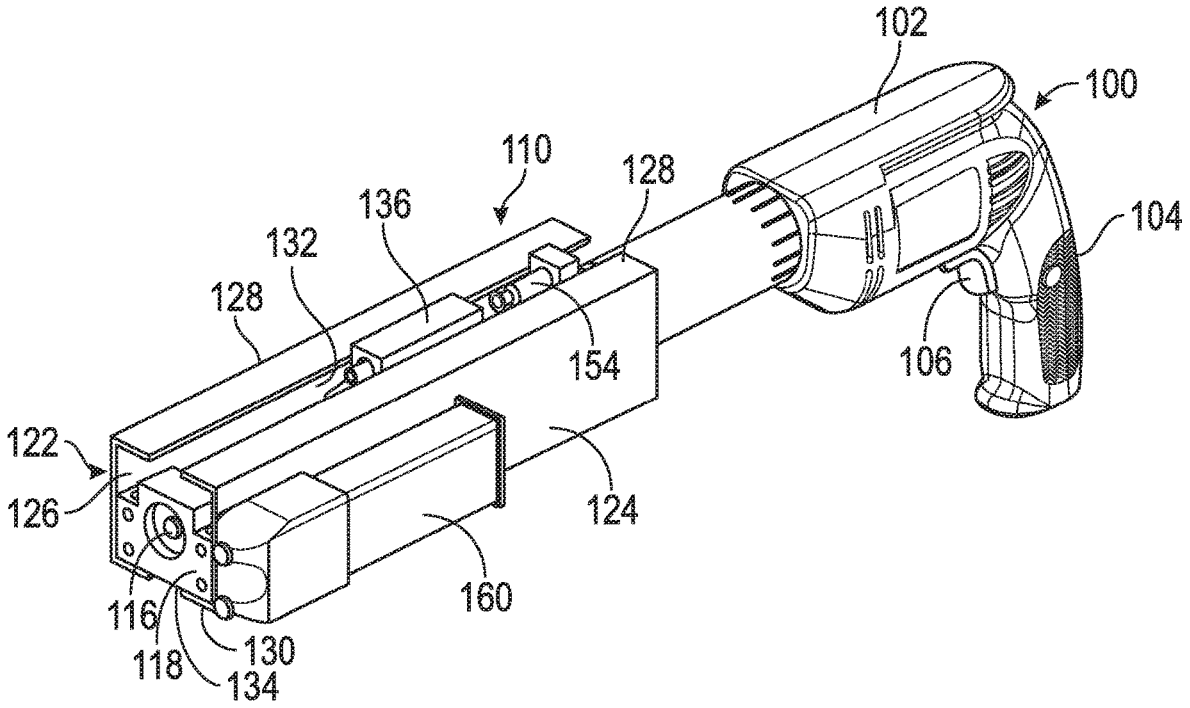
FIG. 2 is a perspective view of a hand-held conducted energy device utilizing a threaded engagement pressurization system.
Figure 3:
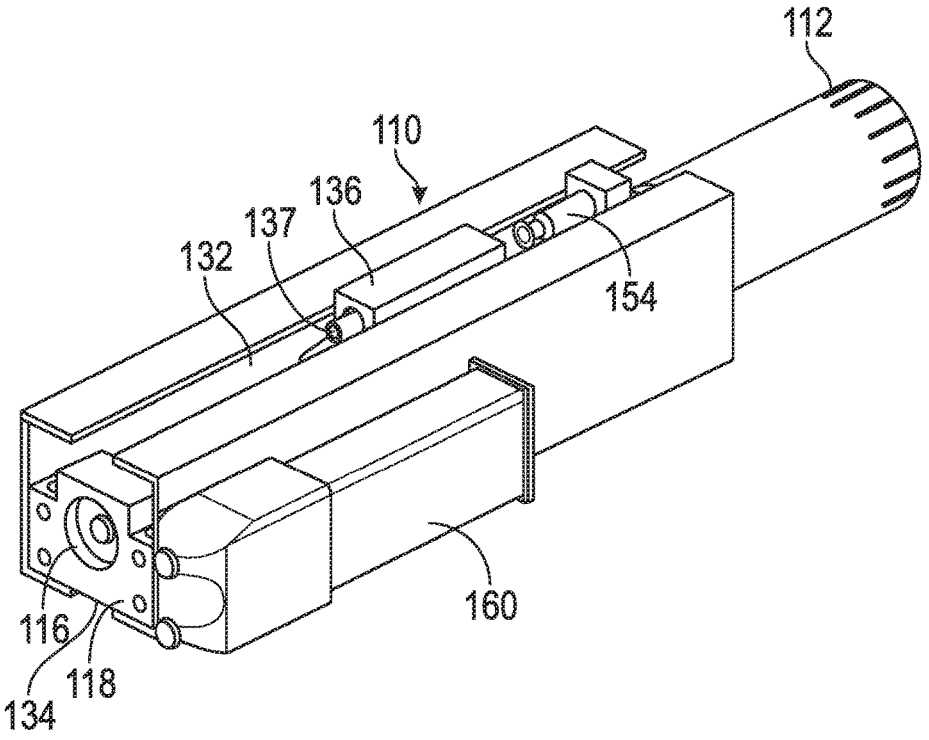
FIG. 3 is a perspective view of the threaded engagement extrusion system of FIG. 2.
Figure 4:
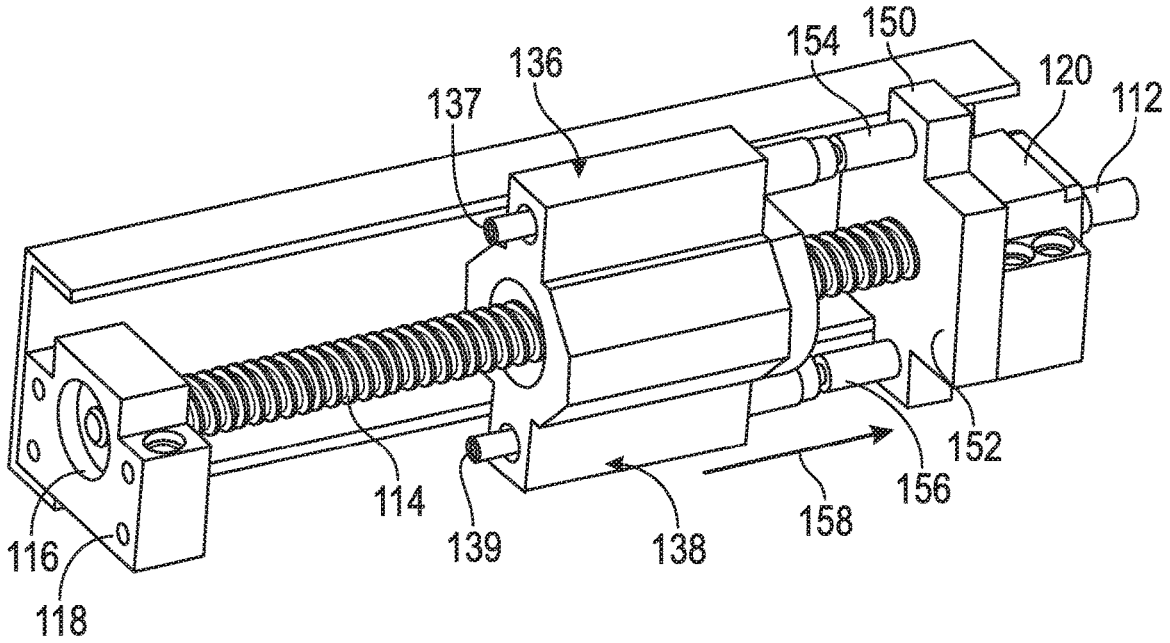
FIG. 4 is a partial cut away view of the threaded engagement extrusion system of FIG. 2

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art which fall within the scope and spirit of the principles of this disclosure.

The figures may not be drawn to scale. In particular, some features may be enlarged relative to other features for clarity. Moreover, where terms such as above, below, over, under, top, bottom, side, right, left, etc., are used, it is to be understood that they are used only for ease of understanding the description. It is contemplated that structures may be oriented otherwise.

DETAILED DESCRIPTION

The present disclosure relates to a conductive energy weapon (CEW) that utilizes pressure on a solid metal material to force the material through an extrusion tip. The pressure and shear force through the extrusion tip sufficiently heat the material into a malleable state and transforms the larger solid metal material into a thread, beam or wire of material that exits the extrusion nozzle with sufficient speed to engage a target that is remote from the CEW. The terms thread, beam, or wire can be utilized interchangeably within this application.

Typically, two threads engage the remote body to complete a circuit through the remote body. When a circuit is completed, non-lethal amounts of current are supplied to the body of a person or animal to temporarily incapacitate the person or animal. In some other embodiments, the ground supplies a return path to complete the circuit such that only one thread may be required.

Utilizing pressure and an extrusion nozzle to create sufficient shear force to heat the metal to an extrudable temperature has advantages over prior CEWS. These advantages include the high initial viscosity of the emerging metal from the orifice, which stabilizes the thread against Rayleigh instability. Also, because of the relatively small diameter, the extruded thread is able to more easily penetrate the air and clothing. Further, the range of the threads is greater than the range of known hand-held, side-arm configured CEWS, including up to or exceeding 40 ft. Additionally, the cost of the conductive, metallic material is relatively low compared to the shots utilized in other CEWS. Also, the threads diameters can increase as air friction slows down the thread which delays corrugation instability.

Also, because the threads do not have insulation after being extruded, any contact along the length of the thread, not just the end of the thread, can transmit a non-lethal amount of electricity. As such, the threads can be swept, like water from a hose, such that a single thread can engage many remote targets in a single sweep. Additionally, if the threads initially 'miss' or do not contact the remote target, the user can steer the threads towards the target to engage it.

An exemplary, but non-limiting, material that can be used in the disclosed CEW is indium. Another exemplary, but non-limiting material that can be used in the disclosed CEW is gold. Indium and gold have unique properties that allow the materials to be extruded at temperatures below the melting temperature. Gold and indium both have low ultimate strengths and do not substantially harden when worked such that they can be forced out of a nozzle at a temperature below the melting temperature. While gold can be used as the metal, indium is significantly less expensive than gold and may be typically used due to the difference in cost and required pressures. Other exemplary materials that could be utilized in the CEWs of the present disclosure include lead, tin, thallium, sodium, potassium, cadmium, bismuth, antimony, aluminum, zinc, silver, mercury and combinations or alloys thereof. In some embodiments, strengthening additives can be added to the conductive material, such as metal fibers. However, a length of the fibers must be sufficiently small to prevent clogging of an extrusion nozzle of the CEW.

The physical properties of indium make the material particularly well suited for use in the CEWs of the present disclosure. In particular, indium has a low melting temperature, lack of work hardening, low-strength oxide, low ultimate strength, reasonable price, chemical safety, high density, good electrical conductivity, recyclability and low environmental impact. Indium has a heat capacity of $$Cp = 250 \frac{\text{J}}{\text{Kg deg C.}},$$

a heat of fusion $H_f$=28.5 J/gm, a density $$\rho = 7\ \frac{\text{gm}}{\text{cc}},$$

a melting temperature of $T_m$=156.6° C. and an ultimate strength of about 560 psi. The heat of fusion divided by the heat capacity gives the energy-equivalent temperature rise of the solid to the solid-to-liquid transition.

$$\frac{H_f}{Cp} = 114^\circ\text{C}.$$

For an ambient temperature $T_\alpha$=17° C., the pressure drop required to melt the indium is $$P_{melt} = \left(\frac{H_f}{Cp} + T_m - T_a\right)Cp\,\rho = 16\ \text{Kpsi}$$

Additional pressure is needed if adjoining material (e.g. the nozzle) is heated by the flow. The viscosity of molten indium is so low (1.7 cP) that the viscous drag of the melt is generally negligible. The Bernoulli pressure required to accelerate the extrudate is $$\Delta P_{acc} = \tfrac{1}{2}\rho V^2$$

Based upon the above disclosed physical properties, about 300 psi is required to move indium at about 80 fps.

The amount of pressure required to extrude metals at temperatures below the melting point is dependent upon the $T_m$, $T_a$, $C_p$ and shear strength of the metal. The pressure required to extrude metal at temperatures below $T_m$ must overcome the work hardened shear strength of the material. Once above the work hardened shear strength, the metal can flow so that viscous heating locally changes the temperature and viscosity of the metal. As the metal is heated to proximate, but below $T_m$, the viscosity of the metal rapidly drops, which allows the metal to be extruded without melting. However, very little flow occurs below a threshold pressure $P_t$. The threshold pressure is independent of thread diameter (ignoring conduction to surrounding material). Further, the thread velocity is determined mostly by the difference between the pressure and $P_t$. Typical operation (e.g. 80 fps) require less than 120% of $P_{melt}$.

Once the conductive material is selected, the amount of pressure required to extrude the material without melting can be determined, which in turn allows a pressurizing mechanism to be selected. For example, the extrusion of metals below their melting temperature can require between about 20 Kpsi and about 100 Kpsi. The present disclosure contemplates a number of pressurizing mechanisms including but not limited to threaded engagement systems, a rack and pinion system, pressurized gas systems and pyrochemical systems, as each system is compact and relatively light so as to be usable in a hand-held CEW.

Exemplary threaded engagement systems include ball screws and jack screws that are driven by an electric drive. By way of example, ball screw systems and roller pinion systems can have mechanical efficiencies that can approach 99%. The efficiencies of the ball screw systems can be advantageous in extending the life or reducing the mass of batteries in the CEWs of the present disclosure.

Exemplary rack and pinion systems include a roller pinion attached to a driver, such as an electric drive. The rack and pinion system includes a rack gear on the barrel of the piston which causes the metal to be extruded at temperatures below $T_m$.

In another embodiment, the pressure can be applied by a pressurized source of gas, such as but not limited to carbon dioxide. The pressure exerted on the material by the pressurized gas can be increased using one or more pressure amplifying systems.

In another embodiment, the pressure can be provided using pyrochemical systems. For instance, the necessary pressure can be provided by igniting a flammable powder, such as gun powder.

The CEWS disclosed in the present disclosure can be utilized in a hand-held side-arm device, a long arm device, on a remote-controlled guided vehicle, as a mounted CEW strategically located within a building or structure and/or as a CEW on an aerial drone. Depending on the type of CEW and the application of the CEW, the weight, size of the thread and amount of metal that can be extruded can vary. For instance, the hand-held, side-arm CEW requires light weight and due to the size will typically be able to extrude a lesser amount of metal during a single extrusion relative to the other above mentioned CEWS. Mounted CEWS within a building or structure can retain large amounts of material, as the CEW is supported by the structure, and therefore can have extended extrusion durations. The mounted CEW can be secured to the structure with an actuator, such that the extruded thread can be moved to engage one or more remote targets.

Due to the length of the long arm CEW, the long arm CEW can have longer extrusion durations relative to the side-arm configured CEW. The aerial drone, which can be useful for riot control, balances weight of the CEW and material to be carried by the drone against the required performance, and therefore can extrude more material in a single extrusion than a side-arm CEW but typically less material than a CEW mounted to a structure. The high power dissipation by an operating drone allows the metal reservoir to be maintained at a temperature closer to the melting point, reducing the required pressure to extrude a thread.

Different applications of cold extrusion CEW are optimized with different energy trade-offs between temperature of the metal material and the amount of pressure required to extrude the material. For example, a side-arm that waits at-the-ready for 6 months, and which might find itself used at low ambient temperatures, should be capable of pressures of 60 Kpsi to mobilize cold alloy. For example, a drone-mounted device, or an architectural installed device, can spend tens of continuous watts maintaining the alloy just below the melt temperature, reducing the maximum required pressure to perhaps 6 Kpsi.

FIG. 1 depicts a schematic drawing of a conducted energy weapon (CEW) at 10. The CEW 10 has a housing 12 that retains first and second extruders 14 and 16 that include first and second barrels 18 and 20 and first and second pistons 22 and 24 that move within the barrels 18 and 20, a respectively.

Each barrel 18 and 20 is configured to retain a cylinder 26 and 28 of solid metallic material 25 and 27 that is extruded through extrusion tips 19 and 21 by forcing the pistons 22 and 24 into the barrels 18 and 20 with a drive 30 coupled to the pistons 22 and 24. The drive 30 is powered by a motor 32 that is supplied energy by a battery pack 34 within the housing.

The CEW 10 also includes a high voltage generator 36 coupled to the battery pack 32 where the high voltage generator is electrically coupled to the first and second extruders. The high voltage generator 36 is configured to send pulses of high voltage electricity to a target 44 once engaged by extruded threads 40 and 42. Pulsing the voltage and current through the threads 40 and 42 optimizes the nervous system coupling for incapacitation without paralyzing muscles, which can occur with continuous direct current.

The CEW 10 also includes a controller 38 that controls at least the length of time the motor 32 is actuated, which in turn controls the length of time that threads 40 and 42 are extruded from the extrusion tips 19 and 21. If the motor 32 is a variable speed motor, the controller 38 can also control the rate of extrusion by controlling the speed of the motor 32. The controller 38 can also control the rate, length and duration of the pulses sent from the high voltage generator 36 to the target 44 through the threads 40 and 42.

As illustrated in FIG. 1, the drive 30 is configured as a threaded engagement of threaded rod 31 coupled the motor and threadably engaging a threaded bore within a plate 33 attach to the pistons 22 and 24. Knowing the pitch of the threaded rod 31 and the rate of rotation and the duration of rotation allows the controller to determine velocity of the pistons 22 and 24 within the barrels 18 and 20. The velocity of the pistons provides feedback to the controller 38 such that drive force on the material and/or the extrusion pressure can be determined and controlled. Further, factoring in the duration of rotation, the cross-sectional area of the material and the cross-sectional area of apertures in the extrusion tips 19 and 21 allows the controller 38 to determine a velocity of the extruded thread, the length of the extruded thread and the amount of material remaining in the barrel 18 and 20 that remains available for extrusion. However, other drive mechanisms are within the scope of the present disclosure.

Further, as illustrated in FIG. 1, the power source for the CEW 10 is a battery pack 34 carried by the CEW. However, in situations where the CEW is mounted in a fixed location, such as in a building or structure, the power can be hard wired to the CEW.

In operation, a user of the CEW 10 locates a remote target 44 to be incapacitated. The operator causes the controller 38 which energizes the motor 32 and causes the drive 30 to rotate the threaded rod 31 which moves the plate 33. As the plate moves 33, the pistons 22 and 24 are driven into the barrels 18 and 20 which applies pressure to the metallic material 25 and 27. As pressure is applied to the material 25 and 27, the threshold pressure $P_t$ is reached, which causes shear through the nozzles 19 and 21, which raises the temperature of the material proximate the nozzles 19 and 21. The combination of the pressure and temperature proximate the nozzles 19 and 21 causes the threads 40 and 42 to be extruded at velocities that can, at times, penetrate clothing of the target 44, such that the high voltage generator 26 can send pulses of current along the threads 40 and 42 to provide an incapacitating, non-lethal amount of current to the target 44. However, typically the circuit is completed by a spark jumping from the thread 40 to the skin, and from the skin back to the other thread 42. The air ions generated by that spark create an ion channel that makes it much easier for subsequent pulses to complete the same circuit.

The threads 40 and 42 typically have a substantially circular cross-section. However, the threads 40 and 42 can have other cross-sectional configuration.

The following CEWS are illustrated as hand-held, side arm CEWS. However, the mechanisms of the disclosed CEWS can be utilized in long arm CEWS, CEWS mounted to buildings or structures and/or mounted to aerial drones.

Referring to FIGS. 2-5, a hand-held, side-arm CEW is illustrated at 100. The CEW 100 include a housing 102 that retains the motor, battery pack, and controls (all of which are not illustrated) but have been previously discussed with respect to the CEW 10. The main housing 102 includes a pistol grip 104 and trigger 106 which are used to grip, aim and deploy threads from the CEW 100.

The extruder portion 110 of the CEW 100 includes a first end 112 coupled to the motor within the main housing 102. The extruder portion 110 includes a threaded shaft 114 supported by bearings 116 and (not shown) within bearing housings 118 and 120. The bearings allow the shaft 114 to be efficiently rotated about an axis of rotation to cause extrusion of the metal material.

The extruder portion 110 includes left and right members 122 and 124 secured to bearing housings 118 and 120. The left and right member 122 and 124 can optionally manufactured from aluminum and are substantially mirror images of each other and include a wall portion 126 and end members 128 and 130 that extend toward each other to form upper and lower channels 132 and 134.

The channels 132 and 134 are sized to allow upper and lower barrels 140 and 142 of upper and lower extruders 136 and 138 to slide therethrough. The upper and lower barrels 140 and 142 are secured to or integral with a nut 144 having a threaded bore 146 that threadably engages the threaded portion of the shaft 114. As the barrels 140 and 142 are secured to the nut 114, the barrels 140 and 142 engage the end members 128 and 130 and prevent rotation of the nut 144 as the shaft 114 is rotated, which causes the nut 144 to move along the shaft 114 within the channels 132 and 134, and extrude threads of conductive material, as discussed below.

The extruder portion 110 includes a mounting plate 150 mounted to the bearing housing 120 which has an aperture 152 that is sized to allow the threaded shaft 114 rotate without engaging the mounting plate 150. The mounting plate 150 has upper and lower pistons 154 and 156 fixedly secured to the mounting plate 150 where the pistons 154 and 156 are aligned with the barrels 140 and 142.

Figure 5:
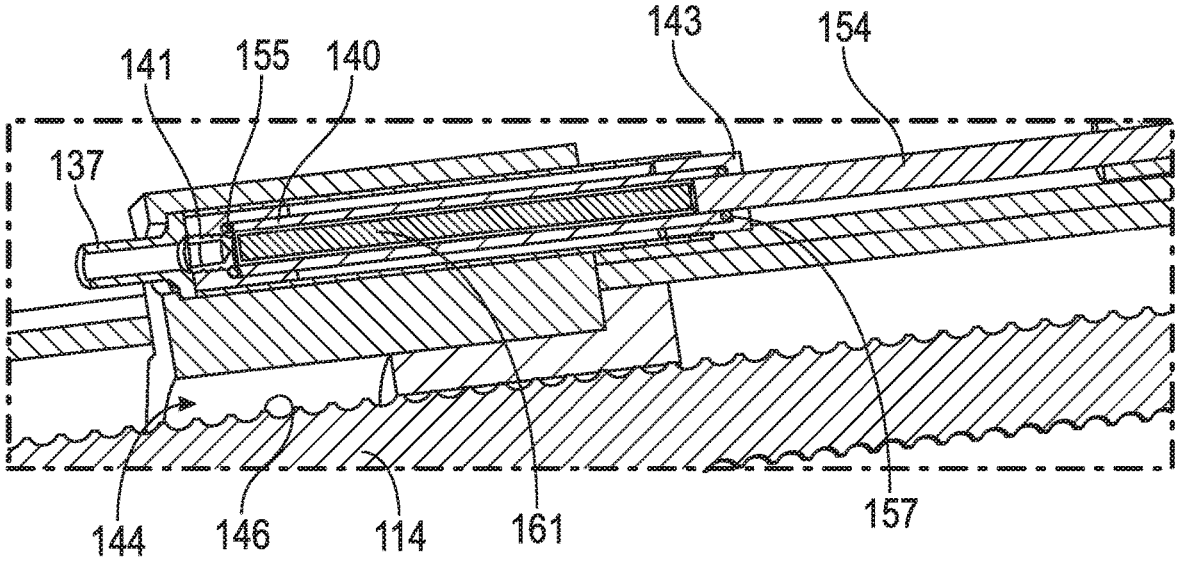
FIG. 5 is a partial cut away view of an extruder pressurized with a threaded engagement.

In operation, the user engages the trigger 106 which causes the motor to be energized and to rotate the shaft 114. Rotation of the threaded shaft 114 causes the nut 144 along with the upper and lower barrels 140 and 142 to move towards the fixed pistons 154 and 156 in the direction of arrow 158. The pistons 154 and 156 engage the metallic material 161 (as illustrated in FIG. 5) within the upper barrel 140 and causes pressure to be exerted on the metallic material until the threshold pressure is exceed proximate a nozzle 141. The nozzles are in communication with insulating caps 139 and 141 that provide insulation to the use while allowing the threads to be extruded. Exceeding the threshold pressure causes the material shear and increase in temperature proximate the nozzle 141 such that the material is extruded at a temperature below the melting temperature.

The pressure is maintained in the barrel 140 with a front O ring 155 that is sized to form a seal between the barrel 140 and the nozzle 141 with the cylindrical material 161 as the material 161 is forced into the extrusion nozzle 141 and with a back O ring 157 that is sized to form a seal with the barrel 150 and the piston 154, as the piston 154 and the material 161 have substantially the same diameter. If a seal is not formed the material may not exceed the threshold pressure $P_t$ and may not properly function.

While described for the extruder 136, the extruder 138 functions similarly to that of the extruder 136, and causes a thread of material to be extruded from the nozzle 143. Once the threads contact the target, a non-lethal dose of current can be supplied from the high voltage pulse generator through the pistons 154 and 156, the supply of material 161 and into the extruded threads to incapacitate the target. The electric current is supplied to the extruded beams by a stunner 160, attached to the member 122, that is electrically coupled to the extruded beams and provides non-lethal doses of electric currently as described with respect to the high voltage generator 36 described with respect to the embodiment 10.

In the event a target can close a distance with the user, two exposed electrodes can be used as a contact stunner.

The CEW 100 also can includes a magazine that contains a supply of material for extrusion such that once the cylinder of material is extruded, the rotational direction of the motor can be reversed to move the nut 144 and barrels 140 and 142 a distance from the pistons 152 and 154 in a direction opposite the arrow 156 such that cylinders of material can be reloaded into the barrels 140 and 142 for additional use of the CEW 100.

By way of non-limiting example, utilizing the embodiment 100 where the threaded shaft 114 and the nut 144 make up a single 16 mm ball screw, the ball screw can advance two 3/16" diameter pistons 154 and 156 to drive alloy 161 through two 4 mil nozzles 141 and 143. At extrusion velocities of 50 fps, 2.5" of piston motion gives 9 seconds of thread duration. Optional sintered metal filters can be assembled just upstream of the orifices to removed particulates and oxides. Ultra-high-pressure grease can be applied to the piston and barrel surfaces to improve sealing and flow.

In some embodiments, the barrels 140 and 142 and the pistons 154 and 156 are encased in Nylon or other insulating material 143 so that the barrels 140 and 142 can be driven at high voltage with respect to the ball screw drive 114, 144 without the risk of shock to the operator.

Referring to FIGS. 6-9, another CEW is illustrated at 200 that utilizes a pressurized gas system to extrude the threads of metallic material. The CEW 200 includes a grip portion 212 and a guard 214 that are configured to be gripped by a human's hand where the guard 214 is configured to allow a finger to pass through an opening 216. The grip portion 212 includes an actuator 217 that is similar to a trigger on a gun.

Figure 6:
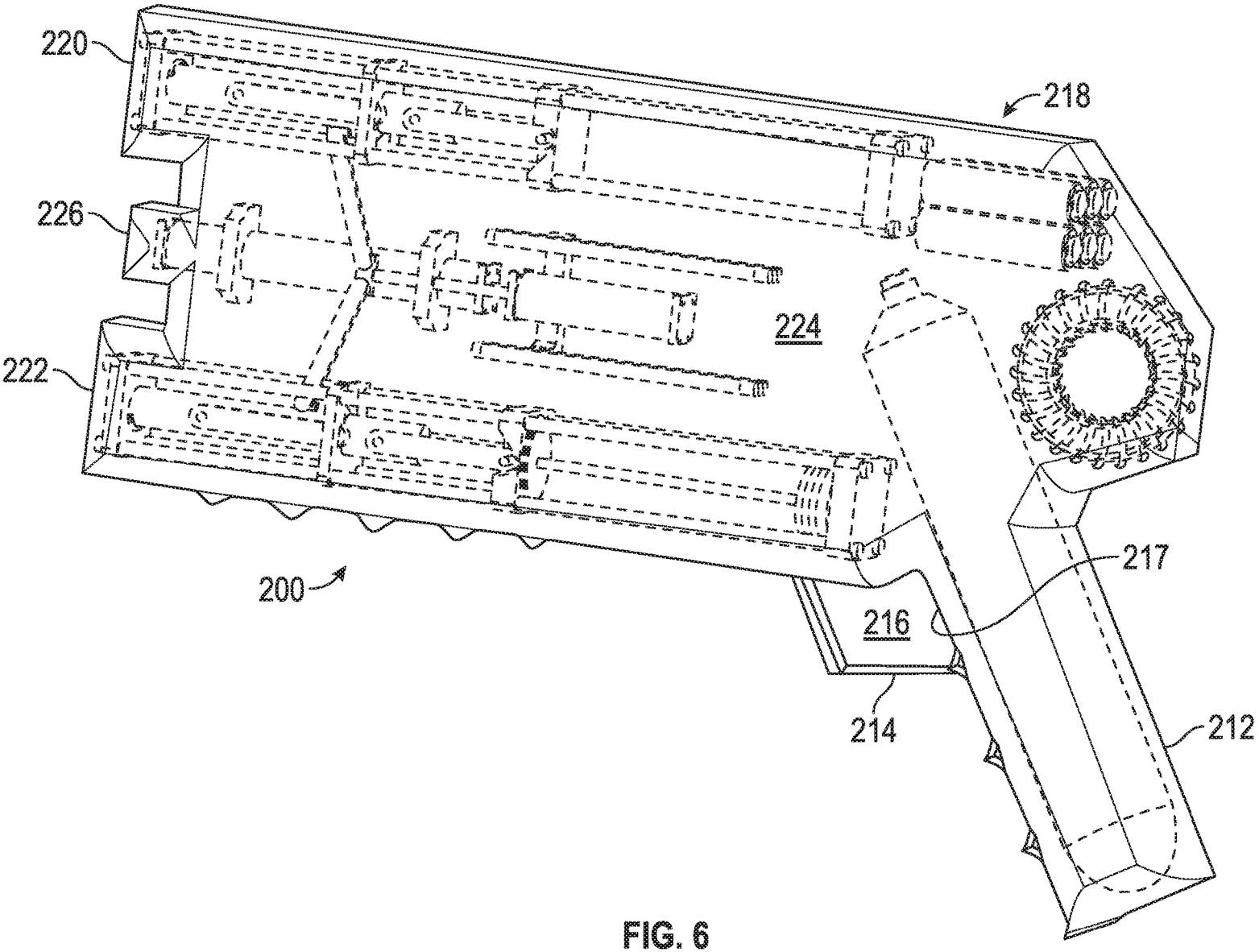
FIG. 6 is a perspective view of a hand-held conducted energy device utilizing a pressurized gas pressurization system.

The CEW 200 includes a main body portion 218 that includes an opening 220 for a top extruder nozzle and an opening 222 for a bottom extruder nozzle 222. The main body portion includes an interior cavity 224 configured to retain the interior parts of the CEW 200. As illustrated in FIG. 6, a portion of a cocking cylinder 226 extends from the main body portion 218, where the cocking device 226 is able to move through an aperture in the main body portion 218 to move the interior part to an active position to extrude threads of metal therethrough using the actuator 217.

Figure 7:
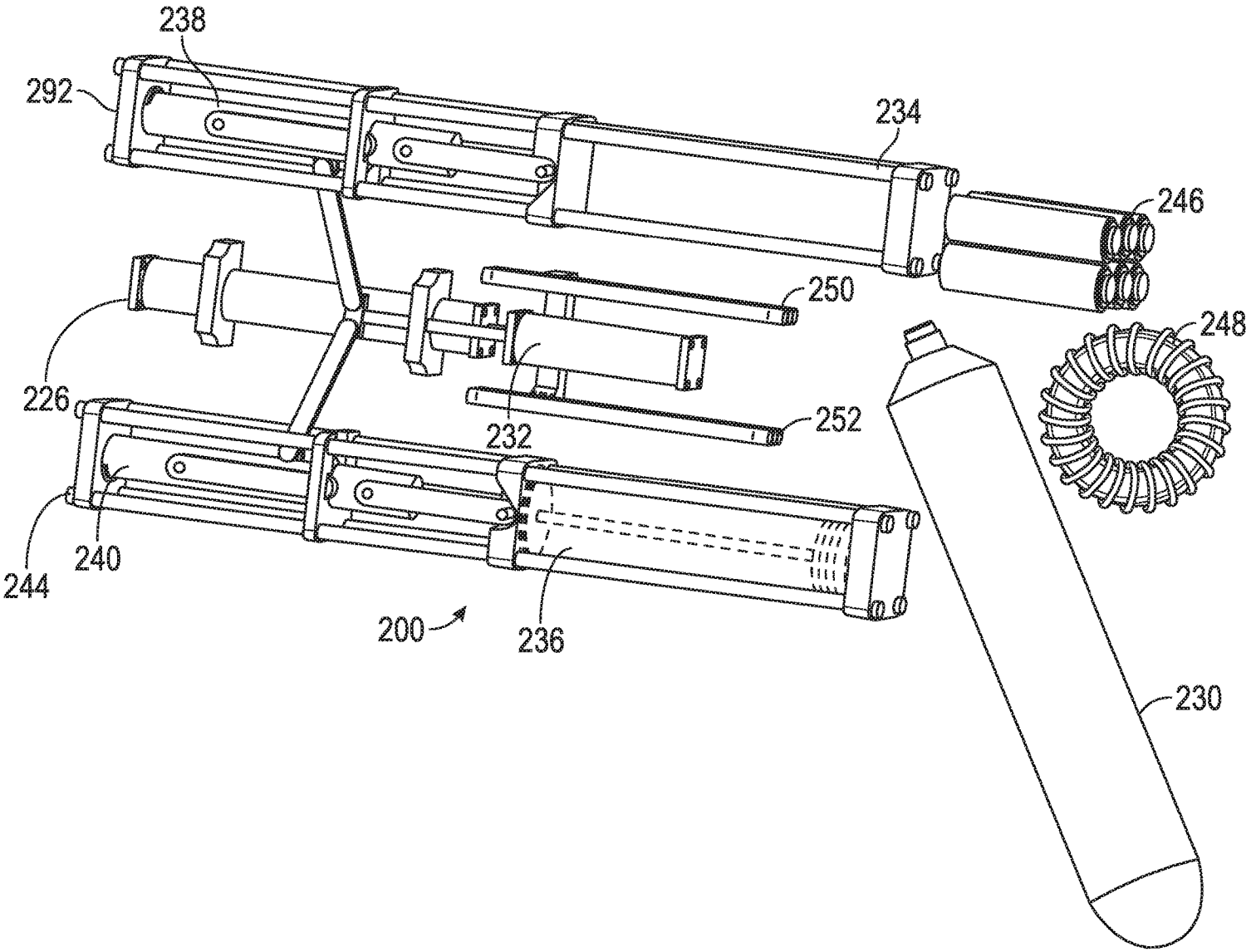
FIG. 7 is a schematic view of the hand-held conducted energy device of FIG. 6 in an active position.
Figure 8:
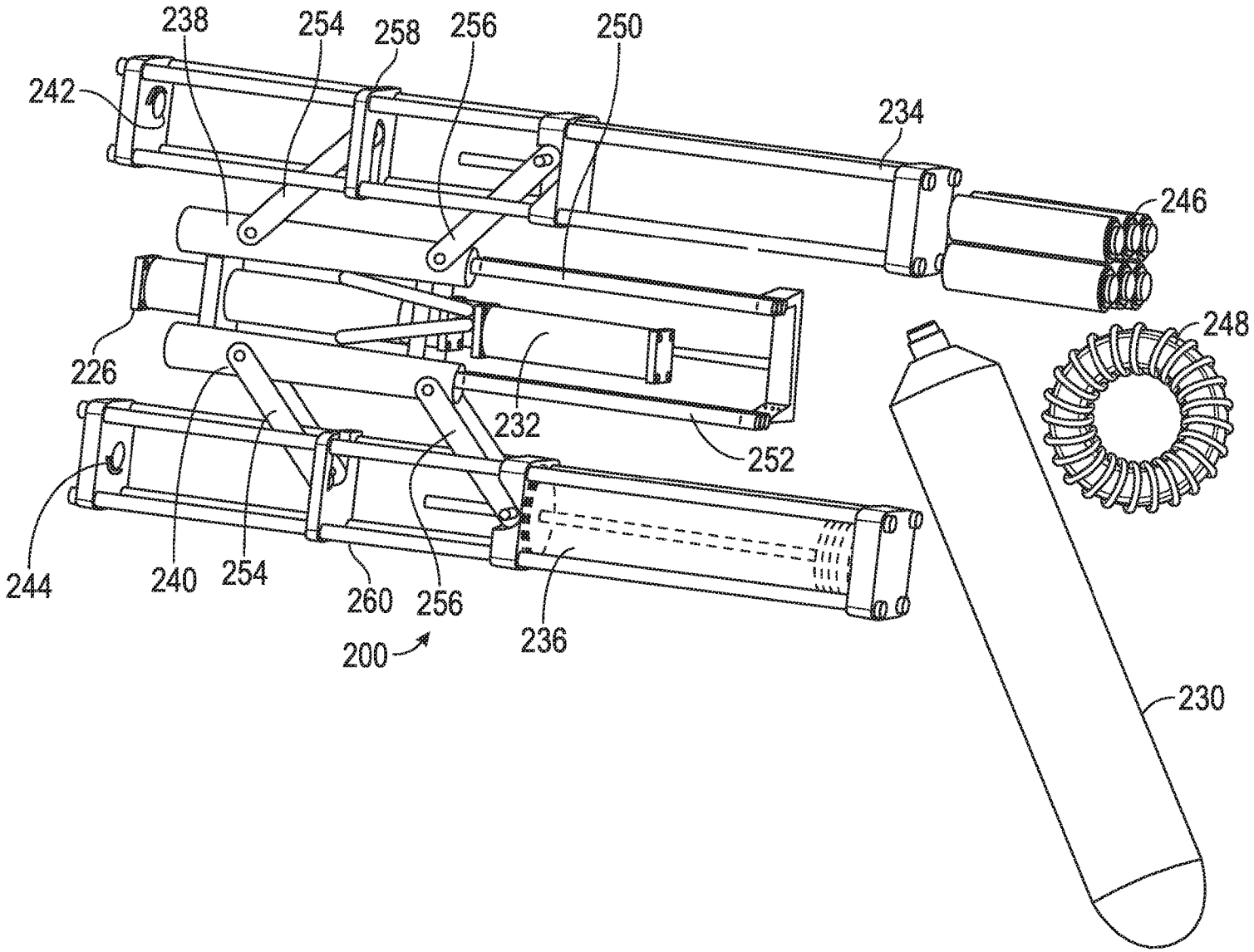
FIG. 8 is a schematic view of the hand-held conducted energy device of FIG. 6 in a loading position.

Referring to FIGS. 7 and 8, the CEW 10 includes a cartridge 230 of gas, which can be carbon dioxide or other non-hazardous gas that is retained in the grip portion 212. The cartridge 230 is removable from the grip portion 212 such that once the gas is sufficiently discharged to cause a low pressure, the cartridge 230 can be replaced with another full cartridge.

The cartridge 230 is in fluid communication with upper and lower intensifiers 234 and 236. The intensifiers 234 and 236 utilize cylinders of different sizes to increase the pressure exerted on the ingots of metal, such as indium, within a barrel 238 and 240. The increased pressure causes the solid ingots of metal to engage an extrusion nozzle 242 and 244 at a distal end of the upper and lower barrels 238 and 240.

Engaging the solid metal with the extrusion nozzles 242 and 244 under pressure causes a shear force that heats the metal to a state that can extrude a thread of metal at a speed that can penetrate a target's clothing and possibly the target's skin, as described above. The energy is provided by one or more batteries 246 that provides electricity to a high voltage discharge coil 248, wherein the discharge coil 248 provides the necessary electricity to non-lethally, incapacitate the target.

The CEW 200 also includes upper and lower magazines 250 and 252 that contain one or more ingots of metal such that, once the ingots in the barrels 238 and 240 are consumed, the CEW can be quickly reloaded using the magazines 250 and 252, along with a reloading cylinder 232 that is in fluid communication with the cartridge 230 to force one or more ingots into the barrels 238 and 240.

FIG. 7 illustrates the CEW 200 in an operating position ready to extrude threads of metal as the barrels 238 and 240 are aligned with the pressure intensifiers 234 and 326, respectively. FIG. 8 illustrates the CEW 200 in a loading position where the upper and lower barrels 238 and 240 are aligned with the upper and lower magazines 250 and 252. With the upper and lower barrels 238 and 240 aligned with the upper and lower magazines 250 and 252.

The upper and lower barrels 238 and 240 are raised into a retracted position by activating the cocking cylinder 226 which causes the barrels to move on spaced apart pairs of front and back linkages 254 and 256 pivotally attached to the barrels 238 and 240 and upper and lower mounting brackets 258 and 260 that retains the intensifiers 234 and 236. The pivotal movement aligns the upper and lower barrels 238 and 240 with the upper and lower magazines 250 and 252 such that ingots can be forced into the barrels 238 and 240 by activating reloading cylinder 232.

Once the ingots are located in the barrels 238 and 240 the barrels 238 and 240 are returned to the operating position, as illustrated in FIG. 7, through movement with the spaced apart pairs of front and back linkages 238 and 240. While a four-point linkage attachment is disclosed, the linkage can have at least three linkage points.

Figure 9:
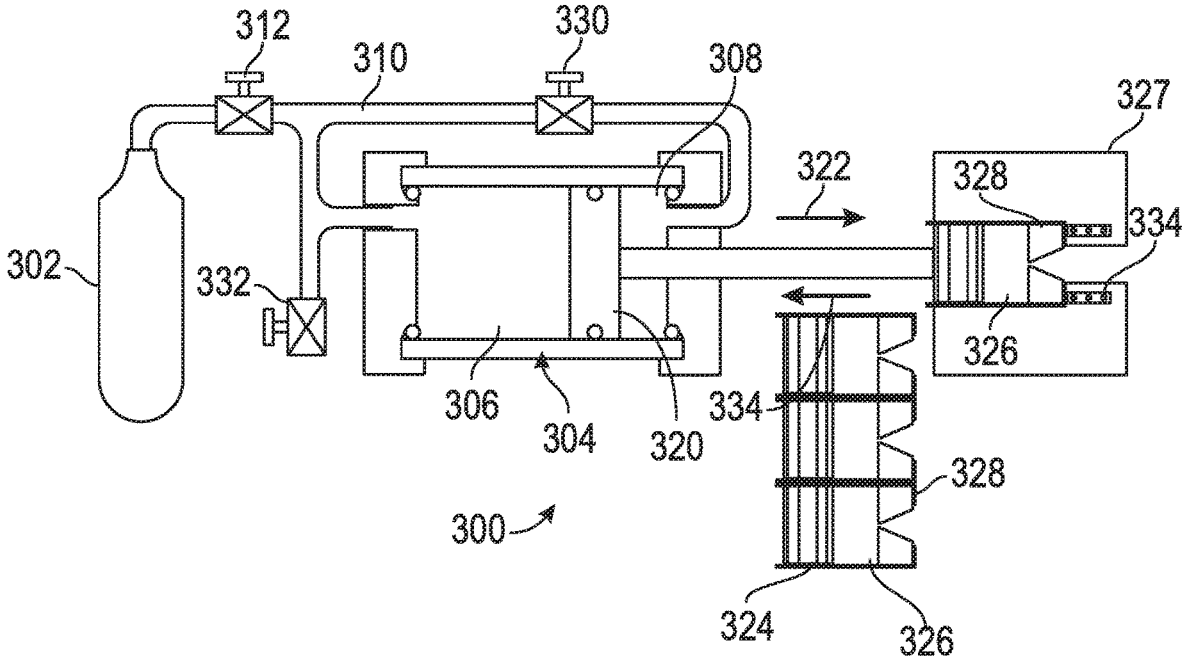
FIG. 9 is a schematic view of a pressure system for use in the hand-held conducted energy device.

FIG. 9 is a schematic diagram of a system 300 used to extrude a thread of metal material with pressurized gas. The system 300 includes a supply 302 that is in fluid communication with a low pressure side 306 of a pneumatic piston 304 with a conduit 310. The conduit 310 includes a trigger valve 312 that is actuated by a user to cause a thread of metal to be extruded. When the trigger valve 312 is opened, pressurized gas flows into the low pressure side 306 which causes a piston 320 to move in the direction of arrow 322 and increase the pressure on a high pressure side 308. The pneumatically driven piston 320 creates force on the push rod, which pressurizes the solid alloy 326. The movement of the piston 320 causes a piston case 324 to force the ingot 326 in a barrel 327 into an extrusion nozzle 328, where the pressure and shear force through the nozzle heats the ingot 326 to an extrudable state where a thread of metal material is forced from the nozzle 328.

To reload an ingot 326 into the barrel 327, the trigger valve 312 is closed and a pressure regulation valve 330 is opened to equalize pressure between the side 306 and the side 308 of the piston. The pressure regulation valve 330 is closed and a pressure release valve 332 is opened which causes the piston to move in direction of arrow 334 due to the pressure difference on the sides of the pistons 320.

With the piston 320, the extrusion nozzle 328, can be removed using a compression spring 334 and a new extrusion nozzle 328, ingot 326 and piston case can be reinserted into the barrel 327. The process is then repeated to extrude further threads of metal.

In FIG. 9, the pneumatic piston 304 applies force to the solid ingot 326; the ratio of their diameters is 6, so the pressure gain is 36, and the peak pressure from 500 psi gas is 18 Kpsi (1,900 psi gas would generate 68.4 Kpsi). The pressure regulation valve 330 can be timed to allow a variable amount of gas to press on the right side of the larger piston 320, reducing the applied pressure to the target value (e.g. 16.5 Kpsi) based on the temperature and other variables.

By way of example, the gas supplied to the low pressure side is slowly evolved from a room temperature canister of liquid $CO_2$ is at 820 psi. Applying this pressure to an intensifier (a large-area pneumatic cylinder coupled to a small-area device) with a gain of 20 (a diameter ratio of 4.47) provides the desired 16.4 Kpsi. However, in practice factors like ambient temperature and the number of immediately previous uses of the CO2 supply vary the actual supply pressure. For temperatures down to freezing, the tank pressure falls to 500 psi. For temperatures up to 120 deg F., the tank pressure can be as high as 1,900 psi (full) or 1,400 psi (half full). However, the pressure is sufficient to provide the necessary force to extrude a thread of metal.

For devices intended for indoor use, the intensifier can be designed for the expected ambient pressure. For devices to be used in a variety of climates, the varying source pressure has to be accommodated. This can be done with a traditional regulator, as in high pressure air guns. In one embodiment, the intensifier has a regulation device, feeding the valved source gas to the large drive cylinder, and a metered fraction of that stream to the rear side of the large cycle, adjustably reducing the effective force on the drive cylinder.

It is estimated that the hand-held, side arm CEW 300 will weigh about six pounds with a diagonal length of about 16.8 inches and a thickness of 1.75 inches. It is also estimated that the cost per cartridge pair of Indium is less than $5. The size and cost make the presently disclosed CEW 10 be well suited for hand-held use in a cost-efficient manner.

Figure 10:
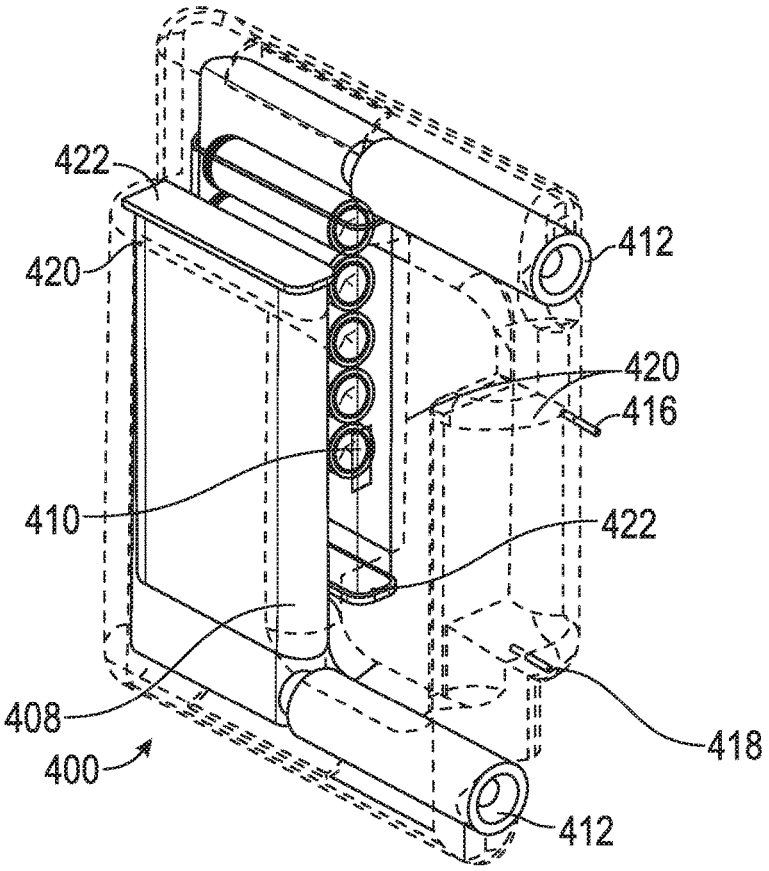
FIG. 10 is a perspective view of another hand-held conducted energy device that utilizes a pyrochemical pressurization system.
Figure 11:
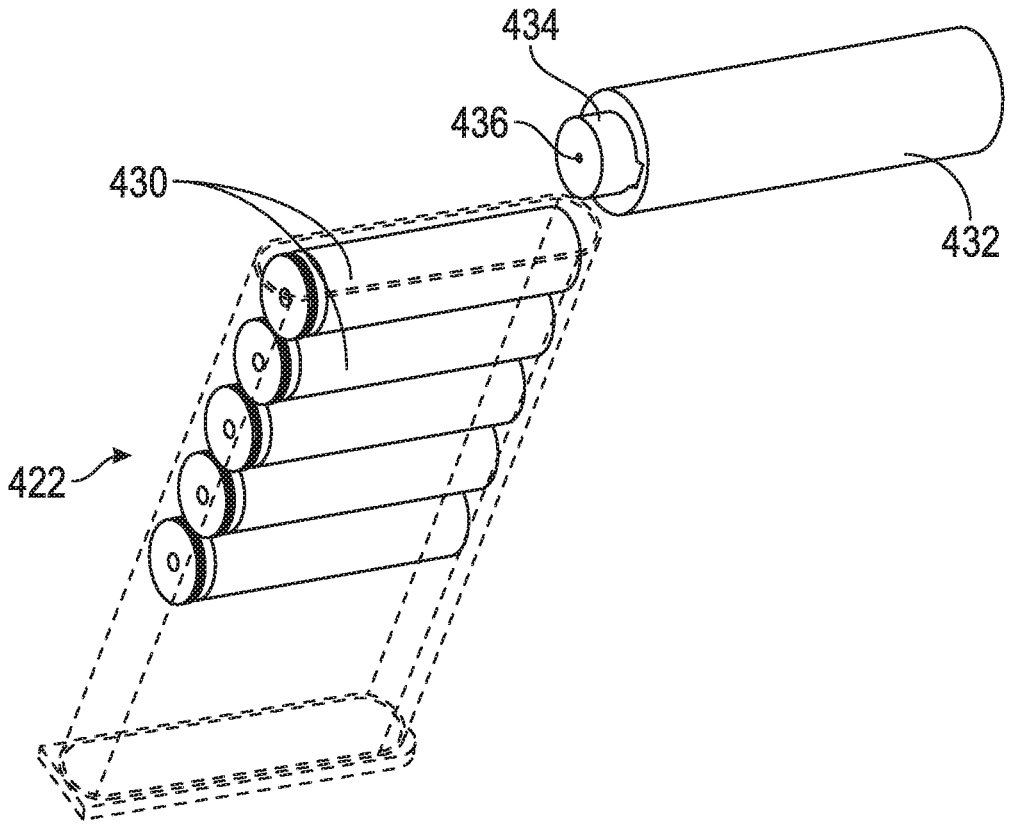
FIG. 11 is a perspective view of a magazine for use with the hand-held conducting device of FIG. 10.
Figure 12:
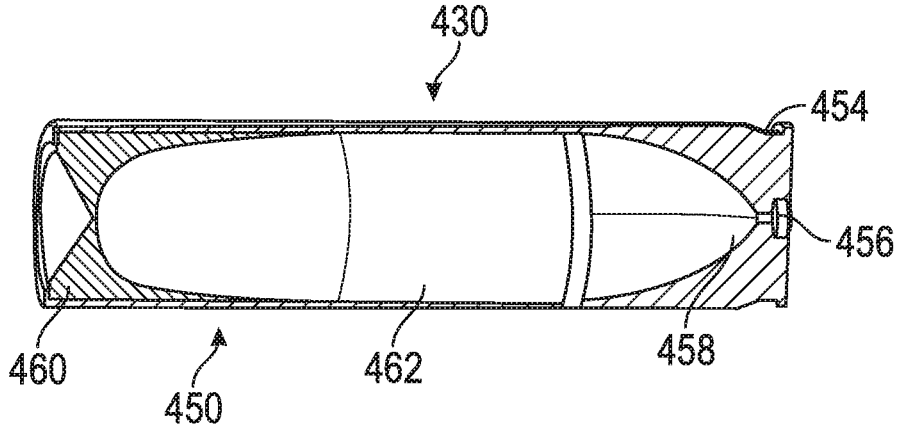
FIG. 12 is a cut away view of a cartridge for use with a magazine for use with the device of FIG. 10.

Another CEW is illustrated at 400 in FIGS. 10-12 that utilizes a pyrochemical systems where a powder charge is used to extrude threads of metal. The CEW 400 includes a housing 402 with a gripping portion 404 with an opening 406 configured to accept a user's finger. The gripping portion 404 can include surfaces 408 configured to retain the user's fingers such that an activation switch 410 can be activated, which causes the extrusion of metal thread through upper and lower extruders 412 and 414.

The CEW 400 include contact electrodes 416 and 418 that can be used to deliver a non-lethal dose of electricity when in close proximity to the target. A battery pack and high voltage generator are located in a front portion 420 of the housing 402, proximate the electrodes 412 and 414.

The housing 402 includes a left receptacle 420 configured to accept a magazine 422 retaining a plurality of cartridges containing the metal for extrusion. The housing 420 also includes a right receptacle (not shown) configured to accept another magazine 422, where the magazine 422 can be used in either receptacle 420 or (not shown). The left receptacle 420 feeds material to the lower extruder 414 and the right receptacle 424 feeds material the upper extruder 412.

Referring to FIG. 11, a magazine 422 is illustrated that is configured to accept a plurality of cartridges 430 that contain the extrusion material. The cartridge 430 is fed to a barrel 432 and breach lock 434 with a firing pin hole 436 is secured proximate one end of the barrel. When the activation switch 410 is activated, a firing pin is forced through the firing pin hole 426 which ignites gun powder in the cartridge 430 and cause the metal to be extruded at a temperature below the melting temperature.

The breach lock 434 is then removed from the barrel 432 which pulls the spent cartridge from the barrel 432. The magazine forces the next cartridge 430 into alignment with the barrel 432 and the breach lock 434 grips the cartridge 430 and forces the cartridge 430 into the barrel 432 such that the cartridge 430 is ready for extrusion.

Referring to FIG. 12, an exemplary cartridge 430 is illustrated. The cartridge 430 includes a casing 450 that is typically brass wherein the casing 450 has an extraction rim 454 that is gripped by the breach lock 434. The cartridge 430 includes a primer 456 is contacted by the firing pin and causes the gun powder or other propellant 458 to force a billet of metal 462, such as indium, through an extrusion nozzle 460 to form the thread of metal material below the melting temperature of the material.

Unlike a typical bullet, the pressure in the cartridge 430 should optimally rise slowly, and be maintained for several seconds. The cartridge 430 will likely be extracted while there is still significant internal pressure, likely causing the cartridge to rupture. Alternatively, a pressure relief mechanism can be provided.

Whatever metallic material is utilized, the type of pressurization system and the type of CEW (hand-held side arm, long arm, automated guided vehicle, structurally mounted or delivered by aerial drone, the thread diameter, range, allow standby temperature, peak pressure (correlated to standby temperature) and thread duration must be accounted for. Table 1 below provides exemplary process criteria for the above listed applications, independent of the pressurization system.

TABLE 1

| | Thread diameter, mils | Range, feet | Alloy min. standby temperature, degC | Peak pressure, psi | Duration, seconds |
|---|---|---|---|---|---|
| Side arm | 3 | 40 | −20 | 40,000 | 8 |
| Long arm | 6 | 120 | −20 | 60,000 | 20 |
| AGV (automated guided vehicle) | 6 | 100 | 130 | 6,000 | 20 |
| Architectural (classroom, bank entrance) | 4 | 50 | 0 | 50,000 | 100 |
| Aerial drone (riot control) | 5 | 100 | 120 | 10,000 | 40 |

Figure 13:
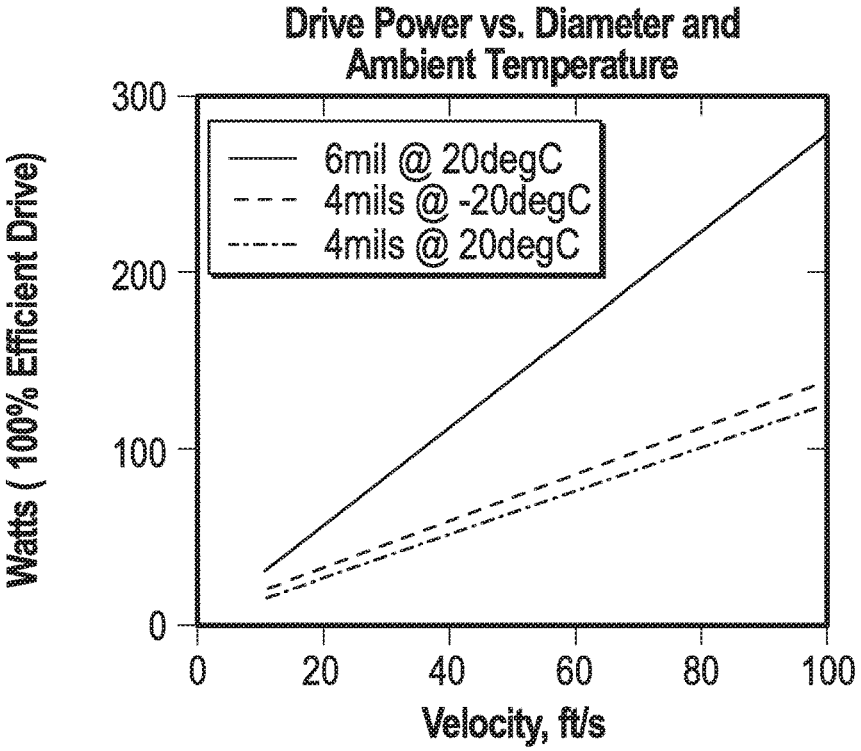
FIG. 13 is a graph of drive power versus diameter and ambient temperature of a material.

The desired thread size increases with the desired range and the required peak pressure increase as standby allow temperature decreases. Further, the amount of power required to extrude the material increases with the diameter of the thread, as more heat is needed to heat the material to an extrudable material relative to a smaller thread. However, initially colder alloy requires more power because obtaining a temperature near melting through shear forces requires a larger temperature change. The correlation of drive power to thread diameter is illustrated in FIG. 13, where a 100% efficient drive is assumed, as well as no thermal conduction to the barrel and orifice.

Figure 14:
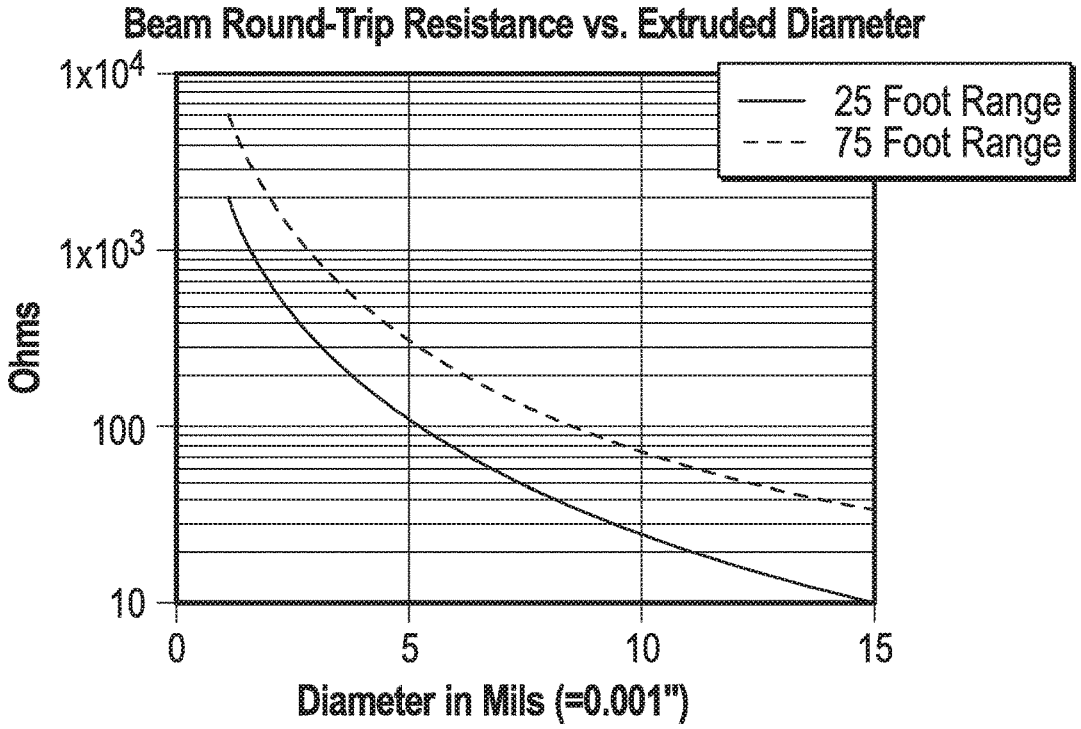
FIG. 14 is a graph of thread round tip resistance versus extruded diameter.

Additionally, it is helpful for the extruded thread to have less electrical resistance relative to the target so that the electrical charge is provided to the target and not dissipated in the thread. FIG. 14 shows the change in web round-trip ohmic resistance with thread diameter and range. As typical dry skin resistance is around 2 Kohm, the web resistance is preferably much less than 4 Kohm. 3 mil Indium web will have a round-trip resistance of 1 Kohm at 75 foot range, and 2 mil web at 25 foot range. 4 mil indium web is a preferred embodiment out to 100 foot range.

The thread diameters of the present disclosure range from about 2 mil to about 16 mil depending upon the desired range and the type of CEW. More typically, the thread diameters range from about 3 mil to about 7 mil and even more typically from about 4 mil to about 6 mil.

The required pressure is dependent upon the size of the thread and the standby temperature of the alloy. The required extrusion pressures can range from about a peak pressure of 5,000 psi to about 65,000 psi and more particularly between 6,000 psi and about 60,000 psi an even more particularly between about 10,000 psi and about 60,000 psi.

EXAMPLES

The present disclosure is more particularly described in the following examples that are intended as illustrations only, since numerous modifications and variations within the scope of the present disclosure will be apparent to those skilled in the art.

Example 1

Pure indium was loaded into a D=0.25" diameter steel syringe with a d=0.0063" i.d. orifice/nozzle. The syringe is mounted in a machinist's vice with a screw pitch of pitch=6 turns per inch and a r=10" handle. Approximately $F_{drive}$=10 lbf on the handle caused the handle to turn at $$\frac{\omega}{2\pi} = 0.25 \text{ Hz.}$$

After extruding about 10' of thread, and then waiting an hour, the handle was much more difficult to turn, though thread would emerge slowly.

Assuming no mechanical loss in the vice, the plunger velocity is $$v_{plunger} = \frac{\omega}{2\pi \text{ pitch}} = 0.042 \frac{\text{in}}{\text{s}}$$

The applied torque is $$T = rF_{drive} = 100 \text{ lbf in}$$

The applied power is $$P = T\omega = 17.7 \text{ watt}$$

The output indium thread velocity is $$v_{thread} = v_{plunger}\left(\frac{D}{d}\right)^2 = 5.5 \frac{\text{ft}}{\text{s}}$$

The pressure in the syringe is (again assuming no mechanical loss)

$$p = \frac{4P}{\pi v_{plunger} D^2} = 76.8 \text{ Kpsi}$$

Avoiding fibrillation generally means keeping the rms electrical current through the target below about 4 milliamps. Peak voltages of 100 KV are desirable for clothing penetration. Once breakdown has occurred, a complete circuit is formed from one thread extruder, through the first thread, through the air ions of a discharge (if there is an air gap), through the skin resistance, through the ionic conduction of the body, again through the skin resistance, through a second air ion channel (if required), through the second thread, and back to the second thread extruder. The high voltage source connects between the two thread extruders. The target generally acts as a low-impedance with a few kiloohms of skin resistance, electrical resistance of the threads and of the induction coil generating the high voltage pulse limits the current, as does the induction-limited rise time of the current. While there may be methods to compensate for thread resistances that vary strongly with range, it is helpful for the combined thread resistances to be on the order of a kiloohm or less.

If the range to the target is R, and the thread diameter is D, the resistivity of the thread material should optimally be:

$$\sigma < 1 \text{ Kohm} \frac{\pi D^2}{8R}$$

A metallic conductor such as Indium, having a resistivity of 0.300 uOhm-m, the ratio $$\frac{D^2}{R} = 7.6 \text{ Å},$$

results in a minimum diameter for 50 ft range of 4.2 mils.

The faster the threads travels, the more quickly the thread material is consumed, so lower speeds are advantageous in many instances is better. To obtain a 50 ft range, the speed ranges from about 80 feet per second to about 400 feet per second. It has been observed that instabilities appear at the higher velocities. However, lower speeds can be beneficial to avoid a build up of a pile of the threads, which can lead to a short circuit.

The quantity market price for indium is presently about \$230/kg, or \$1.60/cc. The flow rate for two threads moving at velocity V is, the quantity utilized per shot is defined by:

$$Q = \frac{\pi}{2} D^2 V$$

The expense for the thread material is \$1.42/s for two 6 mil threads at 80 fps. A six second stream at 6 mils and 80 fps requires a 2.7 ml billet, costing about \$10 for Indium. Both provide a relatively low cost and effective non-lethal ability to incapacitate a person or animal.

Example 2

Figure 15:
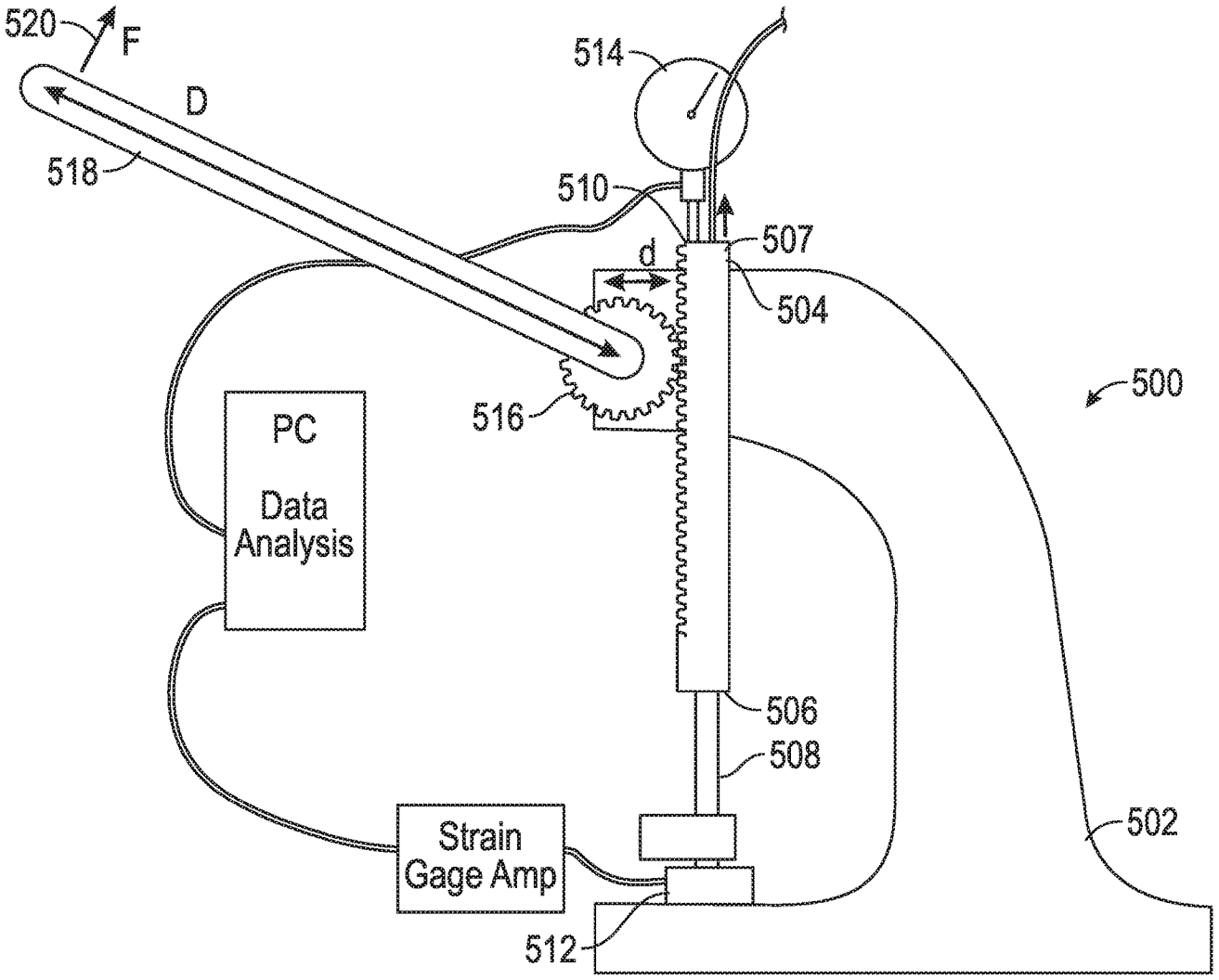
FIG. 15 is a schematic view of an experimental extrusion device that utilizes a rack and pinion pressurization system.

An arbor press used to explore the pressure required to extrude indium threads of different diameter and velocity is illustrated at 500 in FIG. 15. A rack gear 504 supported by a base 502 to retain the rack gear 504 in substantially vertical position. A 0.257" inner diameter through bore was drilled through a length of the rack gear 504, and an o-ring assembly was mounted at a lower end 506 of the bore to seal the bore to a 0.250" diameter carbide piston 508 secured to a bottom portion of the base 502. A nozzle 510, formed from a set screw axially drilled to a 0.006" diameter by 0.010" long hole, or a 0.004" diameter by 0.008" long hole, is tapped to seat in a top end 507 of the drilled-out rack gear. A 5,000 lbf-rated force gage 512 measures the real-time force applied by the arbor press to the piston. The force was applied by a gear 516 rotatably attached to an upper end of the base 502. The diameter of the gear was 6 mil and a length of the lever 518 attached to the gears was 240 mil giving a length to diameter ration of 40. A force was applied in the direction of arrow 520 to force the rack gear 504 downward. A linear gage 514 mounted to the arbor press 500 measured the displacement of the piston 508 into the indium-filled bore of the rack gear 504. Given the metal flow rate through the orifice, and, knowing the orifice diameter, the velocity of the extruded web can be calculated.

Figure 16:
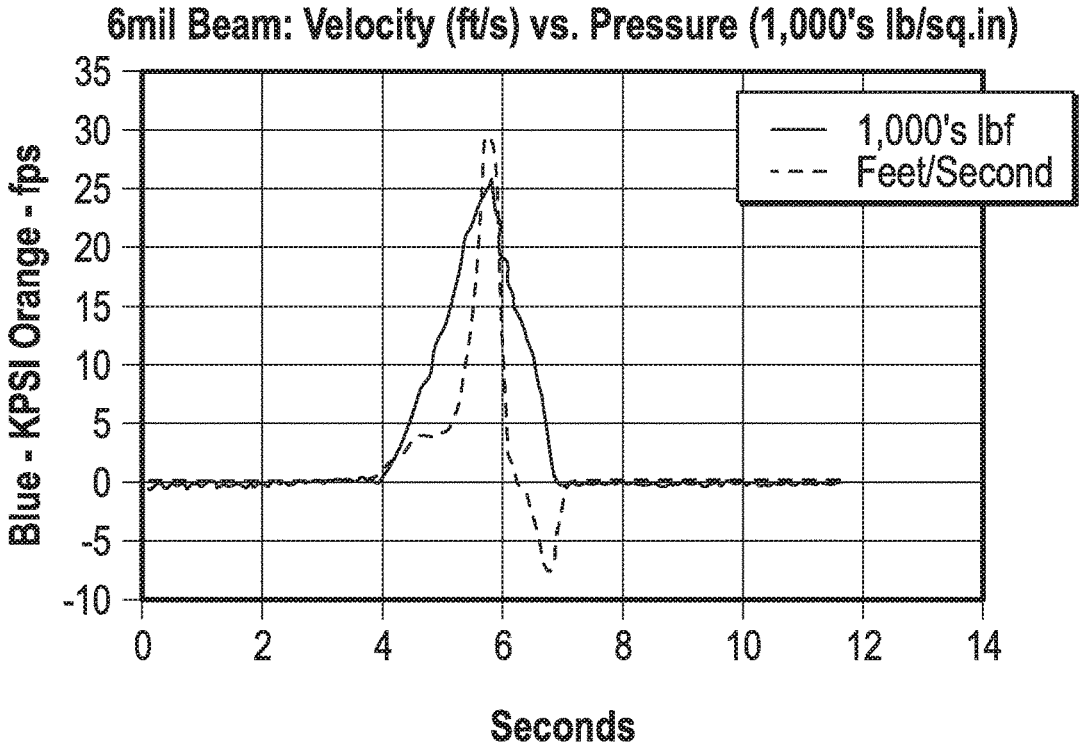
FIG. 16 is a graph of velocity versus pressure for a six mil thread using the system illustrated in FIG. 15.

FIG. 16 plots the raw time-vs-extrusion velocity and time-vs-extrusion pressure superimposed for a nozzle with the 6 mil diameter opening. While some flexing of the arbor press iron casting is apparent at the start and finish of the time sequence, it is apparent that the flow through the nozzle starts around 20,000 psi, reaching a peak of about 30 fps at 30,000 psi.

Figure 17:
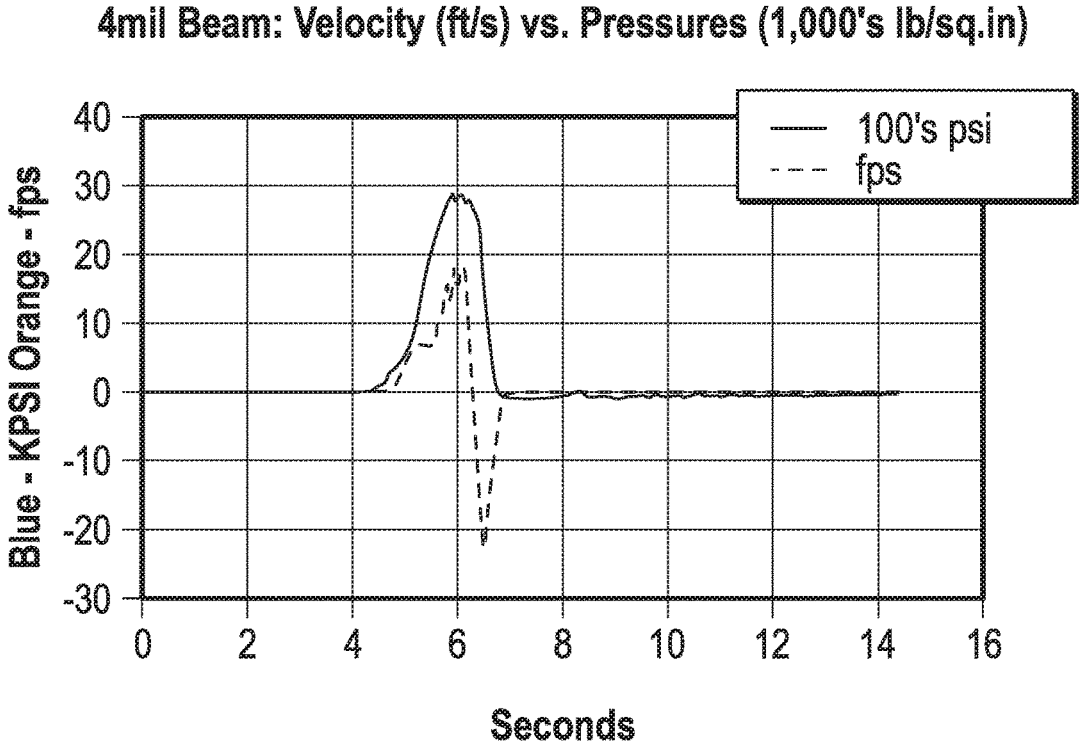
FIG. 17 is a graph of velocity versus pressure for a four mil thread using the system illustrated in FIG. 15.

FIG. 17 plots a similar time-vs-extrusion velocity and time-vs-extrusion pressure plot for a 4 mil diameter opening. Again, the flow commenced around 20,000 psi, and reach a peak velocity around 30,000 psi. These measurements suggest the design point that a cold continuous CEW device should minimally produce 20 Kpsi, and might produce 50 Kpsi for 100 fps webs.

Example 3

Figure 18A:
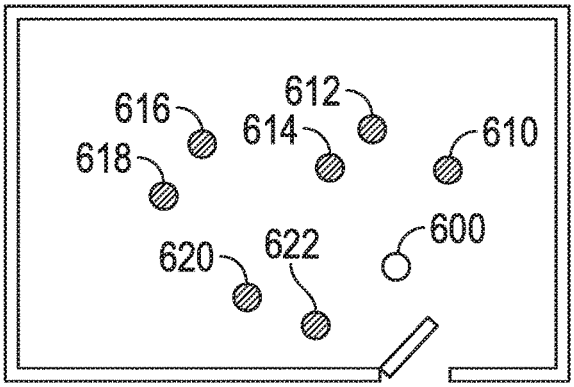
FIGS. 18A-F is a series of schematic drawings illustrating how a single extrusion of threads can incapacitate a plurality of targets.
Figure 18D:
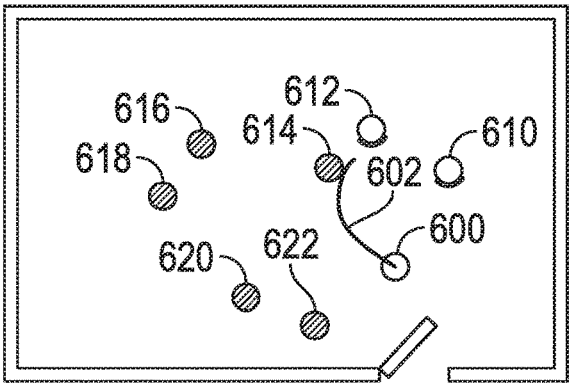
Figure 18B:
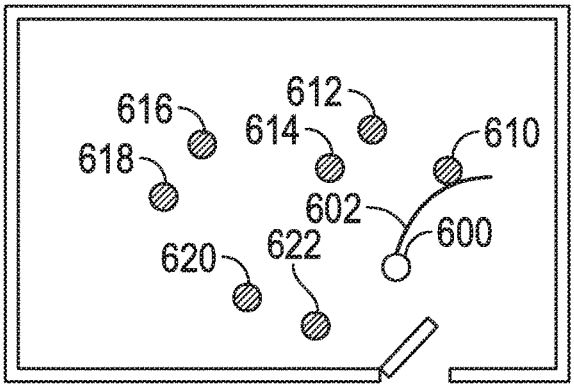
Figure 18E:
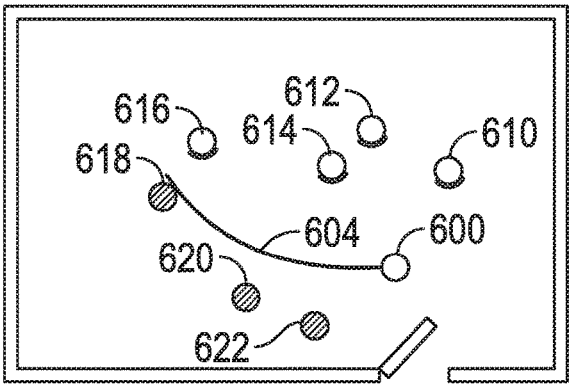
Figure 18C:
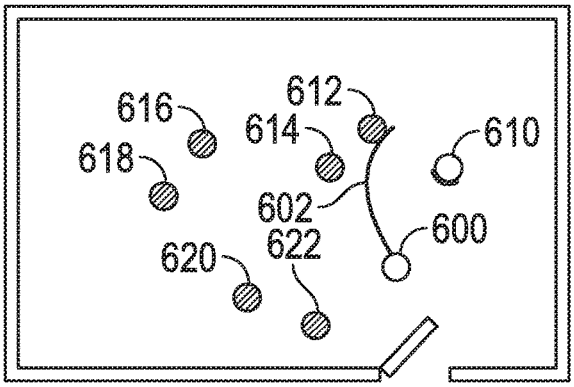
Figure 18F:
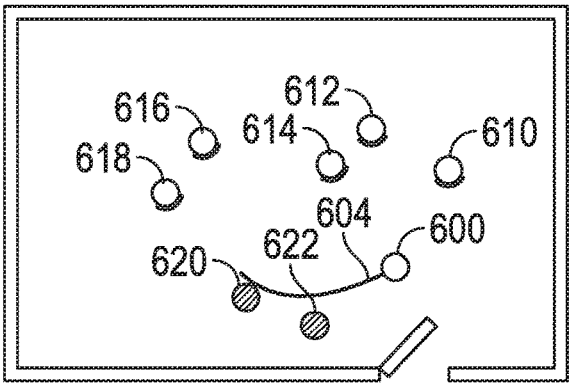

FIGS. 18A-F illustrate how a person with a single CEW of the present disclosure can incapacitate numerous targets with a single sweeping extrusion. In FIG. 18A, the user 600 enters a room with potential targets 610-622. After determining each target was a threat, the user 600 extruded a thread 602 and contacts target 610 in FIG. 18B, target 612 in FIG. 18C, target 614 in FIG. 18D, targets 616 and 618 in FIG. 18E and targets 620 and potentially target 622 in FIG. 18F. It is anticipated that the entire encounter that immobilized six or seven threats could be completed in less than two seconds.

It is understood that components of one embodiment can be utilized in another embodiment in the present disclosure. By way of non-limiting example, sensors, controllers, control schemes, seals and filters disclosed in one embodiment can be utilized in other embodiments.

Although the subject of this disclosure has been described with reference to several embodiments, workers skilled in the art will recognize that changes may be made in form and detail without departing from the spirit and scope of the disclosure. In addition, any feature disclosed with respect to one embodiment may be incorporated in another embodiment, and vice-versa.

What is claimed is:

1. A method of delivering current to a remote target, comprising pressurizing a reservoir of metallic conductor initially at a temperature below its melting point;

flowing the metallic conductor through an orifice to form a continuous thread with axial velocity, so that a user might direct the axial velocity of the thread to intercept the remote target; and applying a potential differential along the thread so that electrical current flows between the reservoir and the remote target.

2. The method of claim 1, wherein the metallic conductor comprises indium.

3. The method of claim 1, wherein pressurizing the reservoir comprises forcing a piston into a first end of a barrel containing the metallic conductor and providing sufficient force to the metallic conductor to cause the metallic conductor to sheer and flow through the orifice at an opposite end of the barrel.

4. The method of claim 3, wherein the piston is forced into the first end of the barrel with a threaded engagement.

5. The method of claim 3, wherein the piston is forced into the first end of the barrel with a rack and pinion system.

6. The method of claim 3, wherein the piston is forced into the first end of the barrel with a pressurized gas system.

7. The method of claim 3 and further comprising utilizing the piston as a source of the metallic conductor.

8. The method of claim 7 and further comprising replacing the piston once the source of the metallic conductor is consumed.

9. The method of claim 3, and further comprising sensing a speed of the piston and utilizing the sensed speed to control pressure proximate the orifice or a driving force upon the metallic conductor.

10. The method of claim 1, wherein pressurizing the reservoir of metallic conductor comprising causing a pyrochemical reaction.

11. The method of claim 1, wherein the current is delivered by a hand-held, side-arm conductive energy weapon.

12. The method of claim 1, wherein the current is delivered by a long arm conductive energy weapon.

13. The method of claim 1, wherein the current is delivered by a conductive energy weapon mounted to an aerial drone.

14. The method of claim 1, wherein the current is delivered by a conductive energy weapon mounted to a structural component of a building.

15. The method of claim 1, wherein the current is delivered by a conductive energy weapon mounted to a remote-controlled guided vehicle.

16. The method of claim 1 and further comprising filtering the metallic conductor prior to flowing from the orifice.

17. A conductive energy weapon configured to extrude a plurality of conductive metallic threads from a conductive metallic material at an initial temperature below a melting temperature of the conductive metallic material, the weapon comprising:

a plurality of spaced apart extruders, each extruder comprising:

a barrel having a first end and a second end and configured to retain a supply of the conductive metallic material;

an extrusion tip having an extrusion orifice;

a piston configured to sealingly move with the barrel from the first end;

a pressurization system configured to engage each piston and configured to move the each piston relative to a respective barrel;

a power supply configured to activate the pressurization system;

an electric pulse generator configured to supply non-lethal electrical energy through the extruded conductive metallic threads; and a controller configured to cause the pressurization system to move the each piston relative to the respective barrel and raise a pressure on the conductive metallic material such that the conductive metallic material shears and raises a temperature proximate the extrusion tip sufficiently to extrude the conductive metallic threads through the extrusion orifice at velocity and to cause electric pulses to travel along the extruded conductive metallic threads.

18. The conductive energy weapon of claim 17, wherein the pressurization system comprises a threaded engagement that rotates a threaded rod and moves a nut attached to the each piston or the respective barrel toward each other.

19. The conductive energy weapon of claim 17, wherein the pressurization system comprises a supply of pressurized gas that engages the each piston and forces the each piston into the barrels.

20. The conductive energy weapon of claim 17, wherein the pressurization system comprises a rack and pinion system on the barrels that forces the barrels to move relative to the pistons.

21. The conductive energy weapon of claim 17, wherein the pressurization system comprises a pyrochemical reaction.

22. The conductive energy weapon of claim 17, wherein the power supply comprises a battery.

23. The conductive energy weapon of claim 17, wherein the weapon is hand-held.

24. The conductive energy weapon of claim 17, wherein the conductive metallic material comprise indium.

25. The conductive energy weapon of claim 17 and further comprising a filter within each barrel proximate the extrusion tip, wherein the filter is configured to prevent particulate from clogging the extrusion orifice.

26. The conductive energy weapon of claim 17 and further comprising a sensor configured to sense a speed of at least one piston, wherein the sensor is configured to send a signal to a controller such that a drive force upon the conductive metallic material or a pressure within the barrel can be controlled.

27. The conductive energy weapon of claim 17, wherein a material of construction of the each piston comprises the conductive metallic material, wherein once the material of the each piston is consumed, the each piston is configured to be replaced with another piston.

28. The conductive energy weapon of claim 17, wherein the velocity of the extruded conductive metallic thread ranges from 10 feet per second to 160 feet per second.

29. The conductive energy weapon of claim 17, wherein the extrusion orifice has a diameter ranging from 3 mils to 16 mils.

* * * * *